United States Patent [19]

Blasiole et al.

[11] 4,007,998

[45] Feb. 15, 1977

[54] BLADE ASSEMBLY

[75] Inventors: George A. Blasiole; Alexander A. Carroll, both of Greensburg, Pa.

[73] Assignee: Carrier Corporation, Syracuse, N.Y.

[22] Filed: Aug. 22, 1975

[21] Appl. No.: 607,073

[52] U.S. Cl. ..... 416/135; 416/221; 416/248; 415/156

[51] Int. Cl.[2] ..... F01D 7/00; F01D 11/00

[58] Field of Search ..... 415/156; 416/135, 248, 416/221

[56] References Cited

UNITED STATES PATENTS

| | | | |
|---|---|---|---|
| 2,445,154 | 7/1948 | Reed | 416/221 |
| 2,997,274 | 8/1961 | Hanson | 416/135 X |
| 3,313,519 | 4/1967 | Jenson | 416/221 |
| 3,525,574 | 8/1970 | Zerlauth | 416/95 X |
| 3,652,177 | 3/1972 | Loebel | 415/156 X |

FOREIGN PATENTS OR APPLICATIONS

| | | | |
|---|---|---|---|
| 300,989 | 9/1965 | Netherlands | 416/135 |
| 250,728 | 7/1948 | Switzerland | 416/221 |
| 755,527 | 8/1956 | United Kingdom | 416/156 |
| 887,098 | 1/1962 | United Kingdom | 416/207 |
| 903,792 | 8/1962 | United Kingdom | 416/207 |
| 965,169 | 7/1964 | United Kingdom | 416/207 |

*Primary Examiner*—Everette A. Powell, Jr.
*Attorney, Agent, or Firm*—J. Raymond Curtin; Thomas J. Wall

[57] ABSTRACT

An adjustable blade assembly for use in a rotary machine, such as a turbine or a compressor, wherein the airfoil is separable from the assembly at the blade platform. The airfoil is provided with a root which is seated within a complementary kerf formed within the platform. Each of the two sections is fabricated independently using standard machine tools, thereby eliminating the need of hand-forming, complex blade contours. In assembly, the airfoil is loosely supported within the platform whereby the stresses generated at resonant frequencies are highly damped.

3 Claims, 2 Drawing Figures

BLADE ASSEMBLY

BACKGROUND OF THE INVENTION

This invention relates to a compressor or turbine adjustable blade assembly which is easily fabricated and which exhibits excellent damping characteristics.

Blades utilized in most turbines and compressors are subjected to high stresses at or near the resonant blade frequency. These stresses induce fatigue fractures within the blade which lead to blade failure. Failure can occur over a relatively long period of time or, under certain operating conditions, in a matter of seconds.

Most blades heretofore have been constructed of a single piece of material which includes both the airfoil and the blade support structure. In general, the contour of the airfoil is generally thinner and relatively wider than that of the root or supporting structure and, as a consequence, a good deal of machining is required to fabricate the blade from a blank. A good deal of waste material is thus generated and the extensive machining required has proven to be costly. Furthermore, hand-contouring of the blade after finished machining is not uncommon. Both the profile of the airfoil and the outer surface of the blade platform are generally complex shapes which, when brought together, describe a geometry that cannot be generated by conventional machine tools. To insure that an unimpeded flow passage is maintained about the blade, the region where the airfoil joins the platform is ordinarily hand-filed to a smooth contour.

SUMMARY OF THE INVENTION

It is therefore an object of the present invention to simplify the construction of a blade utilized in rotary machines, such as turbines and compressors.

A further object of the present invention is to minimize hand-finishing of blades for use in rotary machines.

It is a further object of the present invention to provide a blade structure which is easily fabricated and which exhibits excellent damping characteristics.

These and other objects of the present invention are attained by a blade assembly having an independent airfoil loosely joined to the blade platform by means of an extended root which is seated within a complementary kerf formed within the platform. Spring pins are inserted between the airfoil root and the platform to key the airfoil in place during assembly. Both the airfoil and the platform containing structure of the blade assembly are machined independently from separate pieces of closely sized stock. The airfoil is generated in a multispindle blade mill or the outer periphery of the platform joined thereto is formed by a simple or compound milling operation.

BRIEF DESCRIPTION OF THE DRAWINGS

For a better understanding of the present invention, as well as other objects and further features thereof, reference is had to the following detailed description of the invention to be read in connection with the accompanying drawings, wherein.

DESCRIPTION OF THE PREFERRED EMBODIMENT

Figure 1:
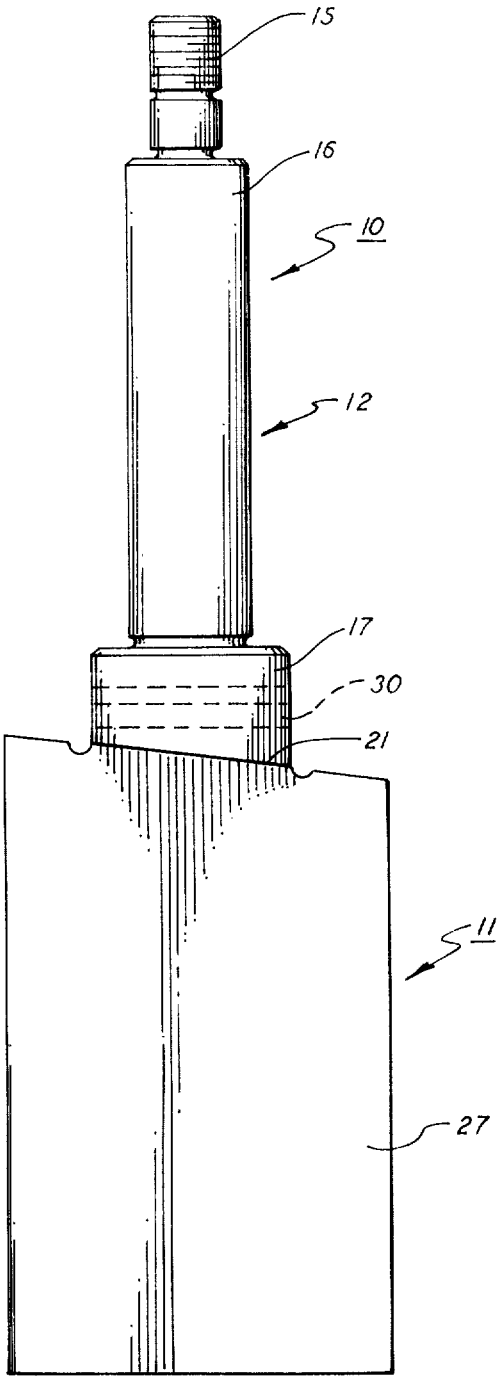
FIG. 1 is a radial view of a blade assembly embodying the teachings of the present invention.

For the purpose of this disclosure, the present blade assembly 10 will be described in reference to an adjustable stator blade assembly as generally employed in an axial compressor. It should be clear to one skilled in the art that the teachings of the present invention are not limited to this particular application and the invention can be similarly employed in any type of suitable blading arrangement.

Referring now to the drawings, the blade assembly is made up of two independent components, an airfoil 11 and an pivotable support member 12. The support member is comprised of a shank 15, a trunnion 16, and a platform 17, all of which have a circular cross-sectional form. As a result, the support member can be conveniently formed upon an automatic screw machine, turret lathe, or the like, from a closely sized piece of bar stock whereby the amount of material removed is minimized. In an axial compressor, the stator blade assembly is generally contained within a radial opening 25 formed in an annular mounting ring 26 or the like.

In assembly, the support member is carried within a complementary opening formed within the mounting ring with the platform thereof seated in a counterbore 28 and the trunnion carried in a radially extended opening whereby the outer periphery of the trunnion acts as a bearing surface against the adjacent mounting ring surface. The shank of the support extends outwardly beyond the ring perimeter and is arranged to operatively engage a suitable drive mechanism adapted to angularly adjust the blade assembly position. As will be explained below, the airfoil is carried in the support member with the blade extending inwardly into the ring opening.

As best illustrated in FIG. 1, the platform of the blade is received within a counterbore formed in the inner wall 20 of a conically-shaped mounting ring. The outer surface 21 of the platform is shaped ideally to complement the cone-shaped inner surface of the ring to present a smooth continuous surface to the fluid moving through the blade passages. In practice, it has been found that when the inside diameter of the ring is relatively large and the chord transcended by the platform surface is relatively small, a flat planar surface capable of being machined by a simple or compound milling operation is suitable to approximate the chordal contour. Accordingly, the outer surface 21 of the platform in the present embodiment represents a flat planar surface which approximates the contour of the supporting wall 20.

A kerf 23 is cut radially, in reference to the axis of the support, through the platform with the centerline of the kerf being coaxially aligned with the plane of development 24 of the airfoil in assembly. The term "plane of development" refers to the imaginary datum about which the blade profile is carried.

Referring now to the airfoil 11, a contoured airfoil 27 is formed with a rectangular root 28. The root complements the kerf formed in the platform and, when assembled therein, is provided with a slight clearance between the outer periphery thereof and the adjacent walls of the kerf. The clearance maintained between the two cojoined members establishes a break or discontinuity in the blade assembly so that excellent damping characteristics are achieved to considerably reduce or eliminate the danger of frequency induced fatigue failure.

Figure 2:
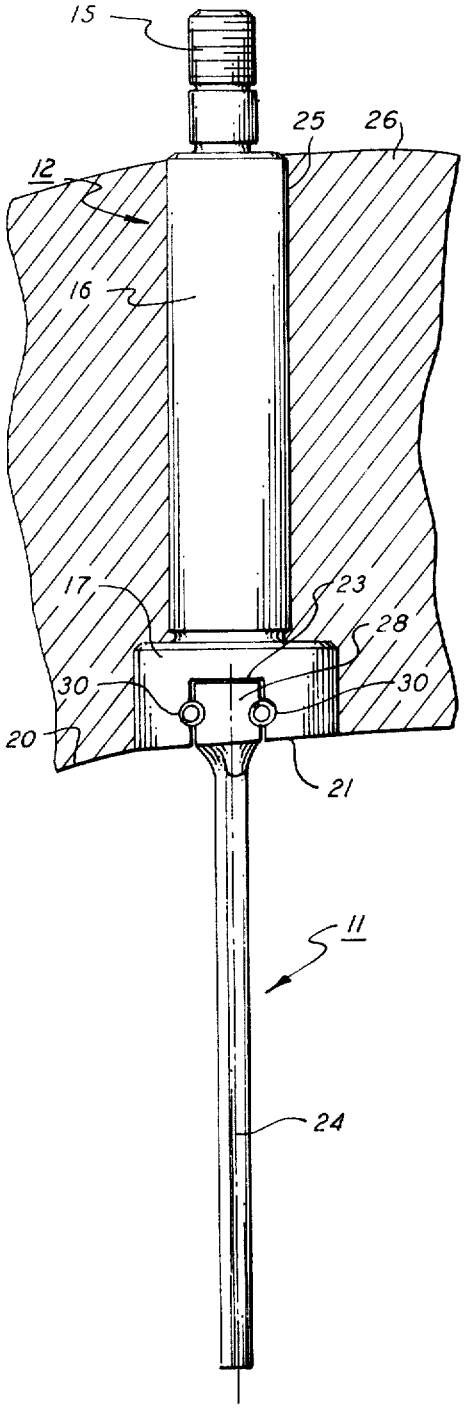
FIG. 2 is an axial view of the blade shown in FIG. 1.

To support the airfoil in assembly, a pair of spring pins 30 are inserted into holes formed through the airfoil root and the platform as illustrated in FIG. 2. In effect, the pins are hollow cylindrical members having an axial slit passing through the pin wall. In the free or unloaded condition, the pin is slightly oversized in relation to the receiving hole. Via a chamfer on one end, the pin is driven or pressed into the hole causing the slit to close. As a result, the pin, in assembly, exerts a continuous biasing force against the cojoined elements thereby locking them in assembly.

Although both sections of the blade assembly can be fabricated of a like material, it is herein contemplated that in many applications dissimilar material will be utilized for both economic and functional reasons. For instance, the airfoil of the blade assembly can be formed of high temperature heat resistant material, while the pivotable support section constructed of a less expensive material. Similarly, the airfoil section can be made of the same base material as the support section, but coated with a suitable alloy for extending blade life. Combinations of dissimilar materials are also envisioned which, when assembled as herein disclosed, will further enhance the damping characteristics of the assembly.

While this invention has been described with reference to the structure herein disclosed, it is not confined to the details as set forth, and this application is intended to cover any modifications or changes as may come within the scope of the following claims.

What is claimed is:

1. An adjustable blade assembly for use in a rotary machine for processing a working fluid, said blade assembly including an airfoil and an independent airfoil support, said support further including a platform of generally cylindrical form having a trunnion secured to one end face thereof, the support being pivotably mounted within a mounting ring with the opposite face of the platform being coextensive with one surface of said ring, said opposite face of the platform having an aperture formed therein, said airfoil being seatable upon said platform and having a root dependent therefrom which is loosely received in said aperture, and means for preventing the airfoil from moving radially in reference to the platform when said airfoil root is positioned within said aperture.

2. The blade assembly of claim 1 further including a shank operatively associated with said trunnion, said shank extending beyond said ring and being engageable with means operable to pivot said blade assembly with said ring.

3. The blade assembly of claim 1 wherein said aperture is a rectangular kerf and said means for preventing the airfoil from moving radially comprises a pair of spring pins, each pin being arranged to engage one side wall of the kerf and one leg of the root when the blade is assembled.

* * * * *